US006388661B1

(12) United States Patent
Richards

(10) Patent No.: US 6,388,661 B1
(45) Date of Patent: May 14, 2002

(54) MONOCHROME AND COLOR DIGITAL DISPLAY SYSTEMS AND METHODS

(75) Inventor: Peter W. Richards, Menlo Park, CA (US)

(73) Assignee: Reflectivity, Inc., Santa Clara, CA (US)

( * ) Notice: Subject to any disclaimer, the term of this patent is extended or adjusted under 35 U.S.C. 154(b) by 0 days.

(21) Appl. No.: 09/564,069

(22) Filed: May 3, 2000

(51) Int. Cl.[7] ..... G09G 5/00

(52) U.S. Cl. ..... 345/204; 345/205; 345/206; 345/690; 345/691; 345/692; 345/693; 345/694; 353/20; 353/84; 348/742; 348/744

(58) Field of Search ..... 345/204, 87, 205, 345/690, 691–694, 206; 348/742, 744; 353/20, 80

(56) References Cited

U.S. PATENT DOCUMENTS

| | | | | | |
|---|---|---|---|---|---|
| 4,367,924 | A | | 1/1983 | Clark et al. | |
| 4,566,935 | A | | 1/1986 | Hornbeck | |
| 5,083,857 | A | | 1/1992 | Hornbeck | |
| 5,192,946 | A | | 3/1993 | Thompson et al. | |
| 5,254,980 | A | | 10/1993 | Hendrix et al. | |
| 5,278,652 | A | | 1/1994 | Urbanus et al. | |
| 5,287,096 | A | | 2/1994 | Thompson et al. | |
| 5,311,360 | A | | 5/1994 | Bloom et al. | |
| 5,339,090 | A | * | 8/1994 | Crossland et al. | 345/205 |
| 5,339,116 | A | | 8/1994 | Urbanus et al. | |
| 5,371,543 | A | | 12/1994 | Anderson | |
| 5,448,314 | A | * | 9/1995 | Heimbuch et al. | 348/743 |
| 5,497,172 | A | | 3/1996 | Doherty et al. | |
| 5,528,317 | A | | 6/1996 | Gove et al. | |
| 5,619,228 | A | | 4/1997 | Doherty | |
| 5,671,083 | A | | 9/1997 | Conner et al. | |
| 5,673,060 | A | * | 9/1997 | Blaxtan et al. | 345/84 |
| 5,731,802 | A | * | 3/1998 | Aras et al. | 345/148 |
| 5,745,193 | A | | 4/1998 | Urbanus et al. | |
| 5,751,379 | A | * | 5/1998 | Markandey et al. | 348/759 |
| 5,767,828 | A | * | 6/1998 | McKnight | 345/89 |
| 5,798,743 | A | * | 8/1998 | Bloom | 345/90 |
| 5,835,256 | A | | 11/1998 | Huibers | |
| 5,859,598 | A | * | 1/1999 | Wade | 340/960 |
| 5,969,710 | A | * | 10/1999 | Doherty et al. | 345/148 |
| 5,977,940 | A | * | 11/1999 | Akiyama et al. | 345/205 |
| 6,046,840 | A | | 4/2000 | Huibers | |
| 6,064,404 | A | * | 5/2000 | Aras et al. | 345/507 |
| 6,104,368 | A | * | 8/2000 | Bonnett et al. | 345/94 |
| 6,107,980 | A | * | 8/2000 | Hermanns et al. | 345/205 |
| 6,175,355 | B1 | * | 1/2001 | Reddy | 345/148 |
| 6,225,991 | B1 | * | 5/2001 | McKnight | 345/205 |
| 6,226,054 | B1 | * | 5/2001 | Morgan et al. | 348/759 |

* cited by examiner

*Primary Examiner*—Richard Hjerpe
*Assistant Examiner*—Henry N. Tran
(74) *Attorney, Agent, or Firm*—Gregory R. Muir

(57) ABSTRACT

Methods and apparatus for producing a pulse-width-modulated (PWM) grayscale or color image using a binary spatial light modulator. By staggering and re-quantizing the PWM intervals to a clock of a period based on the frame time divided by number of rows in the display, the system's peak bandwidth requirements are optimized for displays of arbitrary resolution and arbitrary choice of PWM waveform. Additionally, a gating circuit increases the optical efficiency of a spatial light modulator using this PWM method in a field-sequential color system by reducing the duration of the blanking period between color fields.

52 Claims, 13 Drawing Sheets

MONOCHROME AND COLOR DIGITAL DISPLAY SYSTEMS AND METHODS

This application is related to Disclosure Document #446679 entitled "Group Selection Circuit For Display Device" received by the U.S. Patent and Trademark Office on Oct. 28, 1998.

BACKGROUND OF THE INVENTION

This invention relates to spatial light modulators used for video display systems, and specifically to methods and apparatus for generating grayscale and full-color video images on such display systems.

The well-known cathode ray tube (CRT) is widely used for television (TV) and computer displays. Other display technologies such as the transmissive liquid crystal display (LCD) panel are widely used in certain specialized applications such as displays for portable computers and video projectors.

Market demand is continuously increasing for video displays with higher resolution, greater brightness, lower power, lighter weight, and more compact size. But, as these requirements become more and more stringent, the limitations of conventional CRTs and LCDs become apparent. Microdisplays the size of a silicon chip offer advantages over conventional technologies in resolution, brightness, power, and size. Such microdisplays are often referred to as spatial light modulators (SLMs) since, in many applications, (for example, video projection) they are not viewed directly but instead are used to modulate an incident light beam which forms an image projected on a screen. In other applications such as ultraportable or head-mounted displays, an image on the surface of the SLM may in fact be viewed by the user directly or through magnification optics.

CRTs currently dominate the market for desktop monitors and consumer TVs. But large CRTs are very bulky and expensive. LCD panels are much lighter and thinner than CRTs, but are prohibitively expensive to manufacture in sizes competitive with large CRTs. SLM microdisplays enable cost-effective and compact mid-sized projection displays, reducing the bulk and cost of large desktop monitors and TVs. Desktop computer monitors that would be unreasonably bulky using CRTs and too expensive using LCDs will be cost-effective and compact using SLMs.

Transmissive LCD microdisplays are currently the technology of choice for video projection systems. But, one disadvantage of LCDs is that they require a source of polarized light. LCDs are therefore optically inefficient. Without expensive polarization conversion optics, LCDs are limited to less than 50%-efficient use of an unpolarized light source. Unlike LCDs, micromirror-based SLM displays can use unpolarized light. Using unpolarized light allows projection displays using micromirror SLMs to achieve greater brightness than LCD-based projectors with the same light source, or equivalent brightness with a smaller, lower-power, cheaper light source.

The general operation and architecture of SLMs and SLM-based displays is well known in the industry as shown, for example, in U.S. Pat. No. 6,046,840, U.S. Pat. No. 5,835,256, U.S. Pat. No. 5,311,360, U.S. Pat. No. 4,566,935, and U.S. Pat. No. 4,367,924, the disclosures of which are each hereby incorporated by reference.

FIG. 1 shows the optical design of a typical micromirror SLM-based projection display system. A light source 200 and associated optical system, comprising optical elements 202*a*, 202*b*, and 202*c*, focus a light beam 206 onto the SLM

204. The pixels of the SLM are individually controllable and an image is formed by modulating the incident light beam 206 as desired at each pixel. Micromirror-based projection displays typically modulate the direction of the incident light. For example, to produce a bright pixel in the projected image, the state of the SLM pixel may be set such that the light from that pixel is directed into the projection lens 208. To produce a dark pixel in the projected image, the state of the SLM pixel is set such that the light is directed away from the projection lens 208. Other technologies, such as reflective and transmissive LCDs, use other modulation techniques such as techniques in which the polarization or intensity of the light is modulated.

Modulated light from each SLM pixel passes through a projection lens 208 and is projected on a viewing screen 210, which shows an image composed of bright and dark pixels corresponding to the image data loaded into the SLM 204.

A 'field-sequential color' (FSC) color display may be generated by temporally interleaving separate images in different colors, typically the additive primaries red, green, and blue. This may be accomplished as described in the prior art using a color filter wheel 212 as shown in FIG. 1. As color wheel 212 rotates rapidly, the color of the projected image cycles rapidly between the desired colors. The image on the SLM is synchronized to the wheel such that the different color fields of the full-color image are displayed in sequence. When the color of the light source is varied rapidly enough, the human eye perceives the sequential color fields as a single full-color image.

Other illumination methods may be used to produce a field-sequential color display. For example, in an ultraportable display, colored LEDs could be used for the light source. Instead of using a color wheel, the LEDs may simply be switched on and off as desired.

An additional color technique is to use more than one SLM, typically one per color, and combine their images optically. This solution is bulkier and more expensive than a single-SLM solution, but allows the highest brightness levels for digital cinema and high-end video projection.

In a CRT or conventional LCD panel the brightness of any pixel is an analog value, continuously variable between light and dark. In fast SLMs, such as those based on micromirrors or ferroelectric LCDs, one can operate the pixels in a digital manner. That is, pixels of these devices are driven to one of two states: fully on (bright) or fully off (dark).

To produce the perception of a grayscale or full-color image using such a digital SLM, it is necessary to rapidly modulate the pixels of the display between on and off states such that the average of their modulated brightness waveforms corresponds to the desired 'analog' brightness for each pixel. This technique is generally referred to as pulse-width modulation (PWM). Above a certain modulation frequency, the human eye and brain integrate a pixel's rapidly varying brightness (and color, in a field-sequential color display) and perceive a brightness (and color) determined by the pixel's average illumination over a video frame.

FIG. 2*a* illustrates a typical display system including an SLM 204 and associated control circuitry 300. A video signal source 301, such as a television tuner, MPEG decoder, video disc player, video tape player, PC graphics card, or the like, provides a video signal 304 in any standard format. If necessary, a conversion circuit 302 performs any necessary conversion operations, such as analog to digital conversion, decompression, or luminance/chrominance decoding, in order to convert the provided video signal into digital RGB pixel data 306.

A display controller 308 accepts the incoming pixel data 306, converts it to bit-plane format, and stores it in a frame buffer 310. Display controller 308 retrieves stored bit-plane-formatted data from the frame buffer and provides it to SLM 204 over a data bus 312 according to a predetermined algorithm, such that each pixel displays data from each bit-plane for a duration proportional to that bit-plane's desired PWM weighting, thereby producing a grayscale or color image. Addressing and control signals 404 control which SLM pixels are updated with each write operation.

An alternative display system architecture is shown in FIG. 2*b*. In a standalone application such as in a video-camera or still-camera viewfinder, personal digital assistant (PDA), or a next-generation mobile phone, display controller 308 presents a RAM-like interface 315 to the system's microprocessor 314. Display controller 308 interleaves the microprocessor's frame-buffer read and write operations with the steady stream of read operations moving data from the frame buffer 310 to SLM 204. In another implementation, display controller 308 shares the frame buffer 310 with the system's microprocessor 314 as shown in FIG. 2*c*.

Depending on the application, display controller 308, frame buffer 310, and SLM 204 may be separate devices. Alternatively, two or more of these system components may be integrated onto a single chip.

FIG. 3 illustrates the architecture of SLM 204. Incoming data from the data bus 312 is loaded into bitline driver 402 and driven on the bitlines 400 to the array of memory cells 401. It will be apparent to one of ordinary skill in the art that the width of data bus 312 may be made smaller than the number of bitlines 400 using a shift register or similar structure in bitline driver 402 and using multiple clock cycles to load data into bitline driver 402.

Addressing signals 404 control a row decoder 406 to enable a wordline 412, which causes data to be written from bitlines 400 to a row of the memory cells 401 controlling the states of the light modulating elements 410. Each memory cell 401 allows the written pixels 410 to retain their states until next written. In the intervening time, other rows of the display may be updated. The memory cells 401 may be any well-known data storage circuit such as an SRAM, DRAM, or latch. Alternatively, for some types of light modulating elements 410, the 'memory' may be provided by the inherent bistability of the light-modulating element 410 itself.

A critical constraint on the system design is that the bandwidth or throughput of the SLM data bus 312 is limited. It is possible to increase the throughput of this interface by raising its clock frequency or increasing its bus width. However, these solutions adversely impact the total complexity and cost of the system. Systems that make most efficient use of the available bandwidth between display controller and SLM can use the smallest bus width and/or the lowest bus frequency and will therefore have a cost advantage over less bandwidth-efficient systems.

The prior art in the field of SLMs contains many different methods of controlling an SLM to produce PWM grayscale or color displays. These PWM methods typically share the following goals:

1. Accurately reproduce the desired average signal level and waveform;
2. Maximize optical efficiency by avoiding 'dead times' when a pixel is always off,
3. Maximize bandwidth efficiency by maximizing temporal regularity of activity on the data bus to the SLM;
4. Minimize perceptual artifacts produced by PWM waveforms; and
5. Achieve the above goals with minimum system complexity and cost.

Improving optical efficiency is desirable since it allows for achieving the same system brightness with a lower-power, smaller, cheaper light source. Improving bandwidth efficiency allows for the use of fewer and/or lower-speed data signals to the SLM, thereby reducing packaging cost and system cost. It is also desirable that the system have the flexibility to implement many alternative PWM waveforms in order to fine-tune the system to minimize visual artifacts due to the use of PWM.

As discussed in U.S. Pat. No. 5,731,802, for example, simultaneously achieving the above goals is difficult. Numerous prior methods have less-than-ideal optical efficiency and bandwidth efficiency. For example, methods such as those described in U.S. Pat. Nos. 5,798,743 and 5,745,193 illustrate the challenge of achieving both optical efficiency and bandwidth efficiency. These methods include significant pixel dead times when light is being wasted, and both are somewhat bandwidth-inefficient due to their non-uniform data throughput over the duration of a video frame.

Attempting to show a single bitplane on the entire display at once works poorly due to the extreme bandwidth demands required. Methods such as those described in U.S. Pat. Nos. 5,619,228, 5,497,172 and 5,731,802, achieve better performance by interleaving data from two, three, or more bitplanes, and, at any one time, displaying the data from several different bit-planes on different areas of the display. In this way, the bandwidth load can be distributed more evenly over the frame period. However, these algorithms are difficult to generalize to arbitrary binary or non-binary PWM weightings and arbitrary array sizes.

Some systems, such as those described in U.S. Pat. Nos. 5,278,652 and 5,731,802, rely on clearing the states of pixels to achieve the desired PWM interval weightings. However, clearing methods add undesired complexity to the design of the SLM array and associated control circuitry, and result in pixel dead times which reduce optical efficiency.

Finally, in prior field-sequential-color systems, such as that described in U.S. Pat. No. 5,448,314, the SLM's data bus is idle during the blanking intervals between color fields, wasting bandwidth that might otherwise be put to productive use and unnecessarily extending the amount of pixel 'dead time.' In this example of the prior art, after the blanking interval ends, significant dead time elapses before the PWM waveforms for all rows of the display have begun, contributing to additional optical inefficiency.

SUMMARY OF THE INVENTION

According to the present invention, methods and apparatus are disclosed for producing a pulse-width-modulated (PWM) grayscale or color image using a binary spatial light modulator. By using novel techniques to stagger and re-quantize the rows' PWM intervals to a clock of a period based on the frame time divided by number of rows in the display, the system's peak bandwidth requirements are optimized for displays of arbitrary resolution and arbitrary choice of PWM waveform. Additionally, use of a gating circuit increases the optical efficiency of a spatial light modulator using these PWM techniques in a field-sequential color system by reducing the duration of the blanking period between color fields to the minimum allowed by the data bus bandwidth of the SLM. The gating circuit of the present invention allows an SLM to be preloaded with data during the blanking interval and eliminates pixel dead time after the end of the blanking interval. Optical efficiency and bandwidth efficiency are therefore improved.

The techniques of the present invention provide a grayscale display of arbitrary resolution capable of displaying arbitrary PWM waveforms, which achieves up to 100% bandwidth efficiency, and up to 100% optical efficiency. Such grayscale performance can be achieved using a simple passive, SRAM, DRAM, or latch-based SLM architecture without the complexity and cost of additional SLM circuitry for clearing or double-buffering.

The techniques of the present invention also provide a field-sequential color display of arbitrary resolution capable of displaying arbitrary PWM waveforms, which achieves up to 100% bandwidth efficiency, and improved optical efficiency over the prior art. In particular, pixel 'dead time' is minimized when switching between color fields. A gating circuit allows inter-field dead time to be reduced to a duration limited only by the bandwidth of the SLM interface and the rate at which the illumination system can change the color of the light illuminating the SLM.

Such optical efficiency for field-sequential color is achieved using a simple SRAM or DRAM-based SLM architecture or the like, without the complexity and cost of double-buffering or multiple bits per pixel, when used in conjunction with a simple gating circuit of the system as disclosed herein. For some types of SLMs, such as electrostatically actuated micromirrors, implementation of the gating circuit allows the system to temporarily disable the bias voltage to the light-modulating elements or to temporarily disable illumination of the light-modulating elements, and no additional blanking circuitry within the SLM itself is necessary.

According to an aspect of the present invention, a method is provided for driving a spatial light modulator (SLM), wherein the SLM has a plurality of rows, each row having a plurality of pixels, each pixel comprising a storage bit and a light-modulating element, wherein each of the plurality of rows is updated one or more times during each of a plurality of frames to be displayed by the SLM. The method typically comprises the steps of, during each frame, selecting the rows of the SLM in an update sequence having a plurality of update events, wherein each update event in the update sequence corresponds to a predetermined row of an image and one of a plurality of predetermined bitplanes of the image, each bitplane having a predetermined pixel waveform segment duration; providing a plurality of image data signals to the SLM at each update event, such that the selected row of the SLM is updated with image data corresponding to the selected row and bitplane of the image; and staggering, by a stagger interval, the update events of each row relative to the corresponding update events of a previous row in a row order, wherein during each stagger interval a number of update events occurs, the number of update events occurring in the SLM during each stagger interval being equal to the number of update events occurring for each row during a frame.

According to another aspect of the present invention, a spatial light modulator (SLM) is provided. The SLM typically comprises an array of pixel elements, an array of memory cells coupled to the array of pixel elements and having a plurality of rows, wherein each memory cell controls the state of one of the pixel elements. The SLM also typically includes a plurality of bitlines for providing data signals to the array of memory cells, one row at a time, and a row decoder, wherein the row decoder selects, in response to a row address, one of the plurality of rows of memory cells such that the selected row of memory cells is updated with the data signals provided on the bitlines. In typical operation, during each frame, the rows of the SLM are updated in an update sequence comprising a plurality of update events, each update event in the update sequence corresponding to a predetermined row of an image and one of a plurality of predetermined bitplanes of the image, each bitplane having a predetermined pixel waveform segment duration, and the update events of each row are staggered, by a stagger interval, relative to the corresponding update events of a previous row in a row order, wherein during each stagger interval a number of update events occurs, the number of update events occurring in the SLM during each stagger interval being equal to the number of update events occurring for each row during a frame.

According to yet another aspect of the present invention, a spatial light modulator (SLM) is provided. The SLM typically comprises an array of pixel elements and an array of memory cells coupled to the array of pixel elements and having a plurality of rows, wherein each memory cell controls the state of one of the pixel elements. The SLM also typically includes a blanking means, coupled to the pixel elements, for simultaneously forcing all pixel elements to an off state in response to a blanking signal. The blanking means may include any one of the following:

- any of a plurality of logical gating circuits such as a AND, OR, NAND and NOR gate;
- a switching circuit for disabling a pixel bias voltage; and
- a circuit for disabling illumination of the pixel elements.

According to a further aspect of the present invention, a spatial light modulator (SLM) is provided. The SLM typically comprises an array of pixel elements and an array of memory cells coupled to the array of pixel elements and having a plurality of rows, wherein each memory cell controls the state of one of the pixel elements. The SLM also typically includes a plurality of gating circuits, each gating circuit coupled to one of the pixel elements. In typical operation, when a blanking control signal is applied to the gating circuits, all associated pixel elements are simultaneously forced to an off state regardless of the content of the associated memory cells.

According to still a further aspect of the present invention, a spatial light modulator (SLM) is provided. The SLM typically comprises an array of pixel elements and an array of memory cells coupled to the array of pixel elements and having a plurality of rows, wherein each memory cell controls the state of one of the pixel elements. The SLM also typically includes a switching circuit coupled to all of the pixel elements for providing a bias voltage to all the pixel elements. In typical operation, when the bias voltage is at a first level the state of each pixel is controlled by the control voltage from the respective memory cell, and wherein when the bias voltage is at a second level all pixel elements are in an off state, and when a blanking signal is applied to the switching circuit, the switching circuit switches the bias voltage to the second level such that all pixel elements are simultaneously forced to an off state regardless of the applied control voltages.

According to yet a further aspect of the present invention, a method is provided for driving the pixels of a spatial light modulator (SLM) in a field-sequential color (FSC) display system. The SLM typically includes an array of memory cells coupled to an array of pixel elements, the array of memory cells comprising a plurality of rows, wherein each memory cell controls the state of one of the pixel elements, wherein the FSC system includes a color generating mechanism capable of illuminating the pixel elements with multiple color fields. The method typically comprises the steps of illuminating the pixel elements with the multiple color fields in a cyclical manner, wherein each color field illuminates the SLM one or more times during a frame, and, during each field, selecting the rows of the SLM in an update sequence having a plurality of update events, each update event in the update sequence corresponding to a predetermined row of an image and one of a plurality of predetermined bitplanes of the image, each bitplane having a predetermined pixel waveform segment duration, and providing a plurality of image data signals to the SLM at each update event, such that the selected row of the SLM is updated with image data corresponding to the selected row and bitplane of the image. The method also typically includes the steps of, between each subsequent color field, blanking all pixel elements for an interval having a predetermined duration, and during each blanking interval, pre-loading the memory cells of the SLM such that when the blanking interval ends, the next color field's update sequence may be resumed in a continuous manner so as to eliminate pixel dead time after the end of the blanking interval.

According to an additional aspect of the present invention, a method is provided for reducing an amount of color breakup perceived by a viewer in a field-sequential color (FSC) system having a spatial light modulator (SLM) driven by bitplane data signals, wherein the SLM includes an array of memory cells coupled to an array of pixel elements, wherein each memory cell controls the state of one of the pixel elements, wherein the FSC system includes a color generating mechanism capable of illuminating the pixel elements with multiple color fields. The method typically comprises the steps of illuminating the pixel elements with the multiple color fields in a cyclical manner, wherein each color field illuminates the SLM during each cycle, providing bitplane data signals to the memory cells such that during each color field each of a plurality of rows of memory cells is updated by one or more of a plurality of update bitplanes, each update bitplane having a predetermined weight, and simultaneously blanking all pixel elements one or more times during each separate color field for an interval having a predetermined duration, so as to split each color field into two or more subfields. The method also typically comprises the steps of simultaneously blanking all pixel elements between each separate color field for the interval having the predetermined duration, and during each blanking interval, preloading the memory cells with data such that when the blanking interval ends, the update sequence may be resumed in a continuous manner for the next color field or subfield.

According to yet an additional aspect of the present invention, a method is provided for driving a spatial light modulator (SLM), wherein the SLM has a plurality of rows, each row having a plurality of pixels, wherein each pixel includes a storage bit and a light-modulating element, and wherein each of the plurality of rows is updated with pixel data at each of a plurality of update events during each of a plurality of frames to be displayed by the SLM, wherein each update event has a predetermined weight. The method typically comprises the steps of, for each frame, writing pixel data associated with a first bitplane and a first one of the plurality of rows to the first row at a first update time, and writing pixel data associated with the first bitplane and a second one of the plurality of rows to the second row at a second update time different from the first update time by a stagger interval with duration equal to the frame duration divided by the number of the plurality of rows.

According to yet an additional aspect of the present invention, a method is provided for driving a spatial light modulator (SLM), wherein the SLN has a plurality of rows, each row having a plurality of pixels, wherein each pixel includes a storage bit and a light-modulating element, and wherein each of the plurality of rows is updated with pixel data at a plurality of update events, the events corresponding to at least two bitplanes, during each of a plurality of frames to be displayed by the SLM, wherein each update event has a predetermined weight. The method typically comprises the steps of, for each frame, for each row, writing to the row pixel data associated with the row and a first bitplane at a first update event, the first update event occurring at a first update time wherein the first update time for the row is staggered from the first update time of the previous row by a stagger interval with duration equal to the frame duration divided by the number of the plurality of rows, and for each row, writing to the row pixel data associated with the row and a second bitplane at a second update event, the second update event occurring at a second update time, wherein the second update time for the row is different from the first update time for the row by a duration based on the weight corresponding to the first update event, and wherein the second update time for the row is different from the second update time of the previous row by the stagger interval.

Reference to the remaining portions of the specification, including the drawings and claims, will realize other features and advantages of the present invention. Further features and advantages of the present invention, as well as the structure and operation of various embodiments of the present invention, are described in detail below with respect to the accompanying drawings. In the drawings, like reference numbers indicate identical or functionally similar elements.

Figure 1:
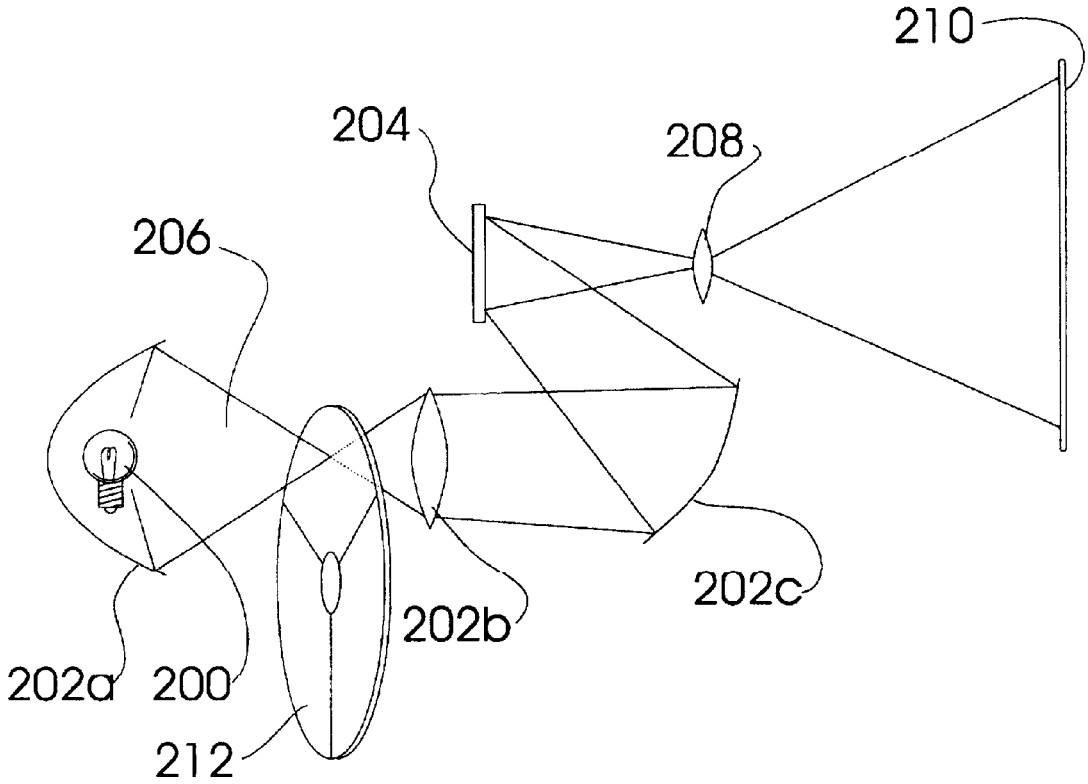
FIG. 1 illustrates a typical SLM-based projection display.
Figure 2A:
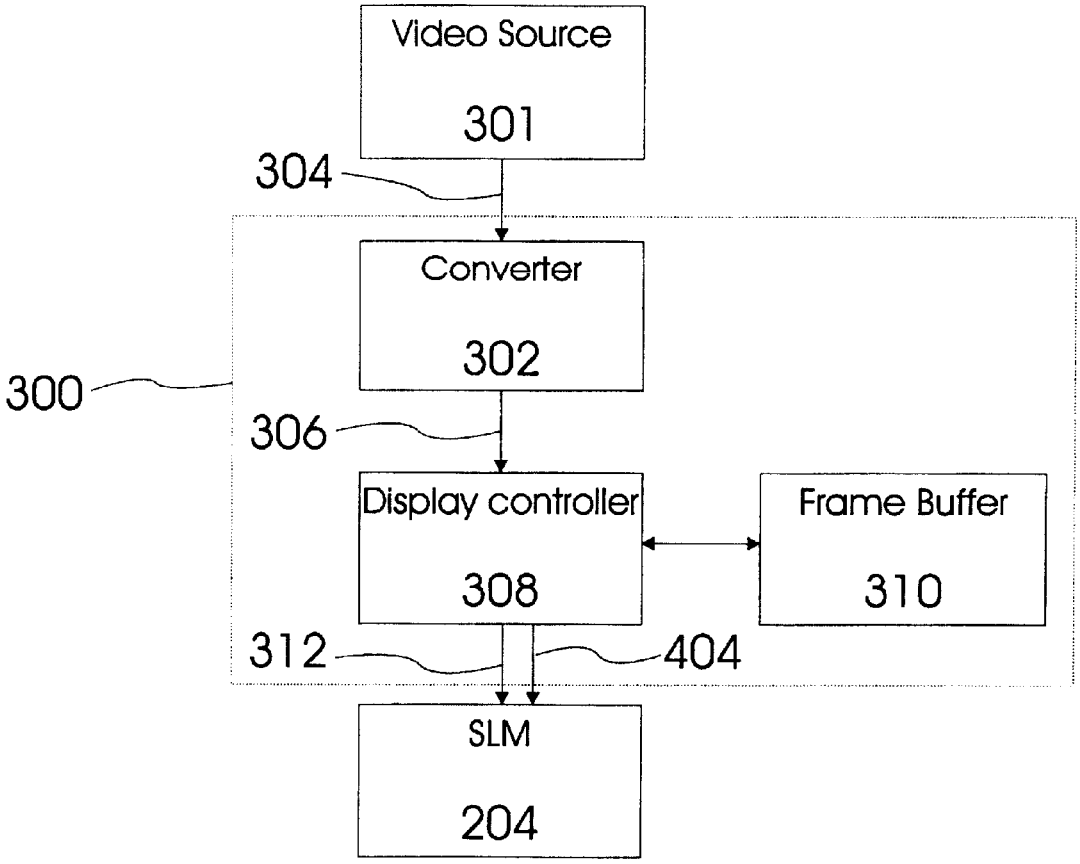
FIG. 2*a* illustrates a typical SLM display system architecture.
Figure 2B:
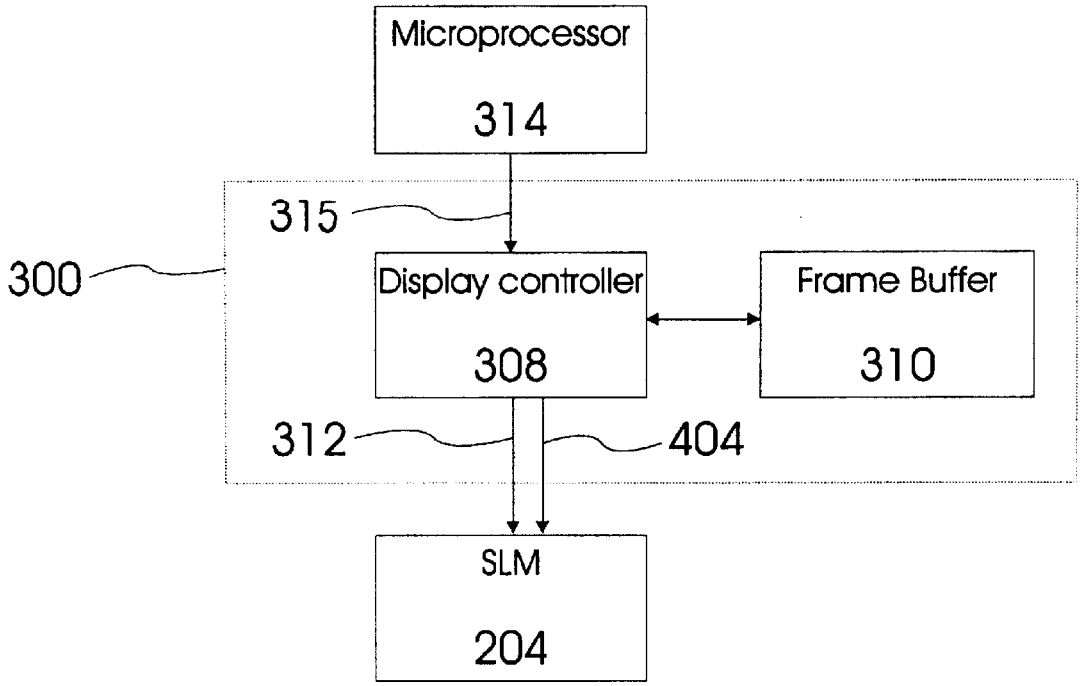
FIG. 2*b* illustrates a typical SLM system architecture for an embedded application.
Figure 2C:
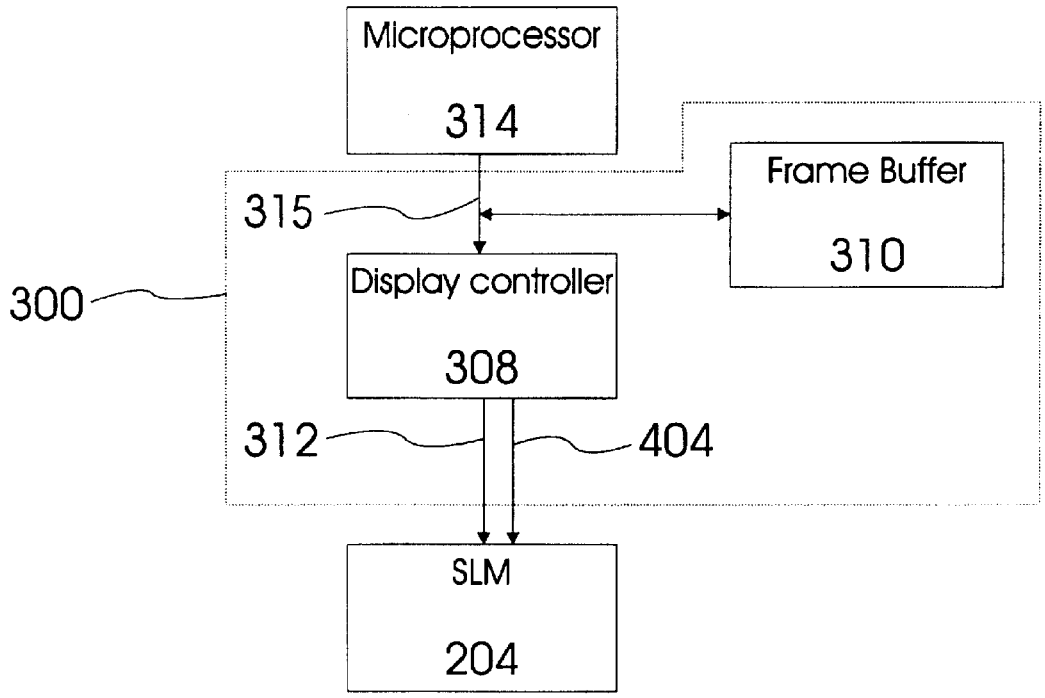
FIG. 2*c* illustrates an alternate architecture for an embedded application.
Figure 3:
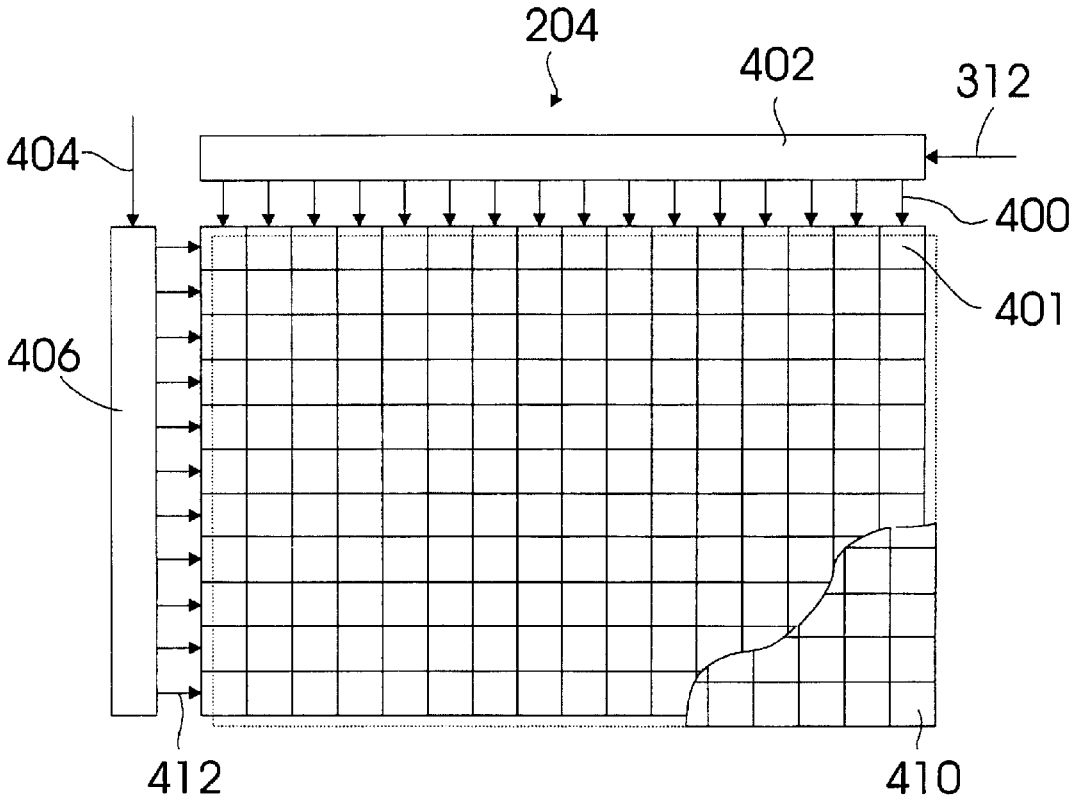
FIG. 3 illustrates a typical SLM array architecture.

| REFERENCE NUMERALS IN THE DRAWINGS | |
|---|---|
| 100 | Example of a PWM waveform of pixel intensity vs. time |
| 102a | Segment of example PWM waveform representing bit 0 (LSB), weight 1 |
| 102b | Segment of example PWM waveform representing bit 1, weight 2 |
| 102c | Segment of example PWM waveform representing bit 2, weight 4 |
| 102d | Segment of example PWM waveform representing bit 3 (MSB), weight 8 |
| 104 | Duration of one LSB |
| 106 | One frame |
| 107a, b | Color fields |
| 108 | Row-stagger interval |
| 109 | Blanking interval |
| 110 | Locally-irregular SLM access pattern timing (before re-quantization) |
| 111a | Update event during stagger interval |
| 111b | Update event with re-quantized timing |
| 112 | Re-quantized SLM access pattern timing |
| 113a, b, c, d | Color sub-fields |
| 114 | Equal sub-intervals of row-stagger interval |
| 116 | PWM waveform after re-quantization |
| 200 | Light source |
| 202a, b, c | Optical elements |
| 204 | Spatial light modulator |
| 206 | Light beam incident on spatial light modulator |
| 208 | Projection lens |
| 210 | Projection screen |
| 212 | Color wheel |
| 300 | SLM display controller |
| 301 | Video signal source |
| 302 | Video signal converter |
| 304 | Input video signal |
| 306 | Digital RGB data |
| 308 | Display controller |
| 310 | Frame buffer |
| 312 | Data bus to SLM |
| 314 | Microprocessor |
| 316 | FIFO buffer |
| 318 | Data bus coupling FIFO to bitline driver |
| 400 | SLM bit lines |
| 401 | SLM memory cells |
| 402 | SLM bit line driver |
| 404 | Address and control signals to SLM |
| 406 | Row decoder |
| 410 | SLM light modulating elements |
| 412 | SLM word lines |
| 413 | Pixel electrode |
| 420 | Blanking gate |
| 422 | Blanking-control signal |
| 424 | Pixel bias voltage |
| 500 | Subinterval counter |
| 501 | Row base counter |
| 502 | Plane look-up table |
| 503 | Row offset look-up table |
| 504 | Row address adder |
| 505 | Selected bitplane |
| 506 | Selected row |
| 508 | Subinterval counter's terminal-count signal |

DESCRIPTION OF THE SPECIFIC EMBODIMENTS

For clarity, the operation of the present invention will now be illustrated using a simplified example of 4-bit grayscale on a 12-row display. It will be apparent to one of ordinary skill in the art that the following discussion applies generally to other PWM waveforms (i.e. other bit depths and/or non-binary weightings) and different display sizes. Further, although not limited thereto, the present invention is particularly useful for operating electrostatically actuated micromirrors such as those described in U.S. Pat. No. 5,835,256, the contents of which are hereby incorporated by reference. Exemplary algorithms for implementing the specific embodiments of the present invention are included in Appendix A, which is included as an integral part of this specification.

Figure 4:
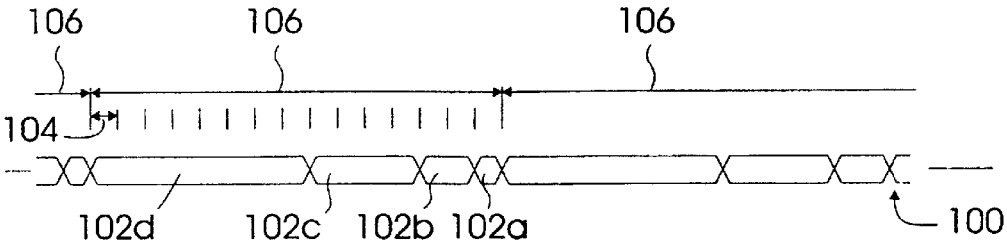
FIG. 4 illustrates an example of a PWM waveform.

FIG. 4 shows an example of a PWM waveform 100 with which the pixels 410 of the SLM display 204 are to be driven. Waveform 100 is composed of repeating frame durations 106 within which waveform 100 is modulated on and off for segments 102*a–d* of predetermined durations or weights. The lengths of the segments 102*a–d* are fixed; different grayscale values are generated by setting the pixel on or off during different combinations of the segments. This simple example shows a 4-bit binary-weighted waveform in which the weights of all segments 102*a–d* are power-of-2 multiples of the least-significant-bit (LSB) duration 104. Specifically, segment 102*a*, representing bit 0 (the LSB) of the pixel intensity, has a weight of 1 LSB, segment 102*b*, representing bit 1 of the pixel intensity, has a weight of 2 LSBs, segment 102*c*, representing bit 2 of the pixel intensity, has a weight of 4 LSBs, and segment 102*d*, representing bit 3 (the MSB) of the pixel intensity, has a weight 8 LSBs. The total duration or weight of all segments 102*a–d* adds up to a weight of 15 LSBs, equivalent to one frame 106. It will be appreciated that any other number of segments and segment weightings could equally well have been chosen. Typically, the number of segments is at least 8, to provide 256 possible grayscale levels. Additional segments may be used to reduce flickering and other visual artifacts resulting from PWM of the pixels. Non-binary segment weightings may equally well be used; the specific weighting scheme will typically be chosen to minimize undesirable perceptual artifacts such as flicker.

Figure 5:
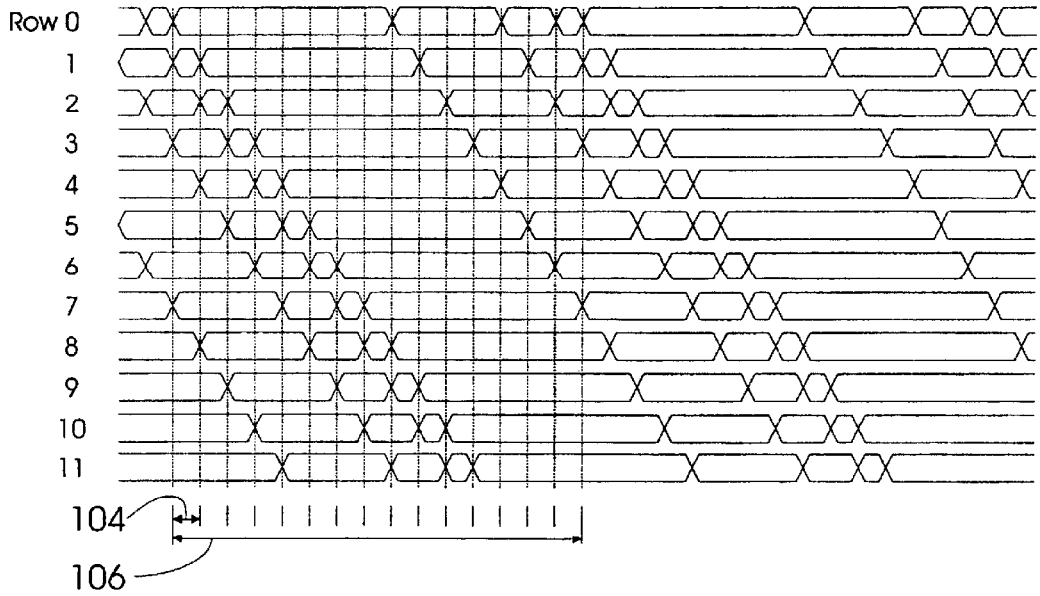
Fig. 5 (prior art)
FIG. 5 illustrates an example of a prior art method of reducing peak bandwidth by staggering the waveforms in time.

FIG. 5 shows an example of a relatively bandwidth-efficient method of generating the desired PWM waveforms on a many-row display as described in U.S. Pat. No. 5,731,802. PWM segment durations are determined by the timing with which rows of the array are updated. Staggering the waveforms in time evens out the bursts of data traffic that would otherwise occur without staggering, and lowers the peak bandwidth required on the interface 312 to the display.

Note that, in FIG. 5, the number of rows (twelve) and the total PWM weight (fifteen) are different. The solution to this situation as disclosed in U.S. Pat. No. 5,731,802 is specifically to 'pad' a the pattern with dummy rows such that the number of 'real' rows plus dummy rows equals the total PWM weight, yielding the pattern shown in FIG. 5. The 12-row pattern is the same as the ideal 15-row pattern, but accesses to the 3 unused, dummy rows become dead cycles in which no data is transferred, thereby reducing bandwidth efficiency. In this example, only 48 of 60 of the frame's time slots are used to transfer data, for a bandwidth efficiency of only 80%.

Table 1 shows the number of row updates per LSB interval 104 for this method. It is apparent that the missing rows introduce a global nonuniformity into the data bus throughput over time, resulting in inefficient use of the data bus 312.

TABLE 1

| LSB interval | Number of update events during interval |
|---|---|
| 0 | 4 |
| 1 | 4 |
| 2 | 4 |
| 3 | 4 |

TABLE 1-continued

| LSB interval | Number of update events during interval |
|---|---|
| 4 | 4 |
| 5 | 3 |
| 6 | 3 |
| 7 | 3 |
| 8 | 4 |
| 9 | 3 |
| 10 | 3 |
| 11 | 2 |
| 12 | 2 |
| 13 | 2 |
| 14 | 3 |
| 15+ | pattern repeats |

Figure 6:
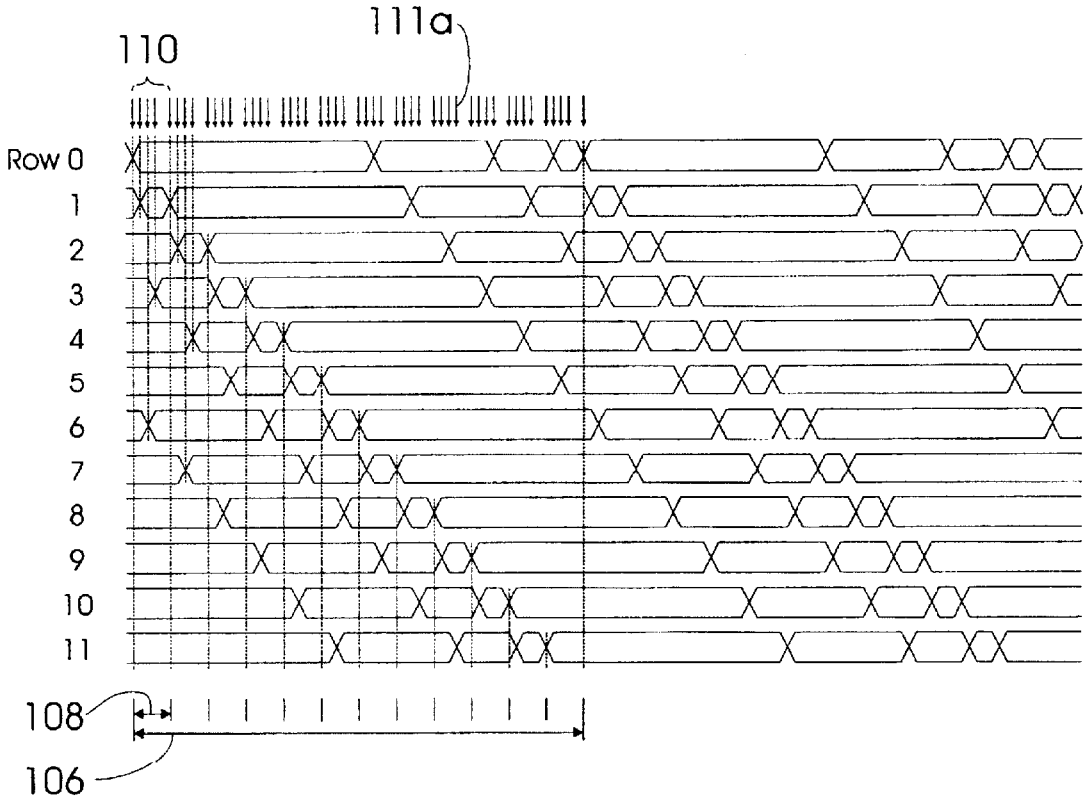
FIG. 6 illustrates a row-staggering method according to an embodiment of the present invention.

FIG. 6 illustrates an improved staggering method according to an embodiment of the present invention. Instead of staggering each row by an amount 104 proportional to an LSB of the PWM waveform, the rows are staggered by a row-stagger interval 108 equal to the frame duration 106 divided by the number of rows. In general this row-stagger interval 108 is not an integer multiple of the LSB duration 104.

This novel staggering method transforms the global bandwidth nonuniformity of FIG. 5 into short-term, local bandwidth non-uniformity for arbitrary combinations of PWM waveform and array size. During each stagger interval 108 of duration D, an irregular pattern 110 of updates 111*a* occurs at a fixed set of times $t_0$, $t_1$, $t_2$, and $t_3$ ($0<=t_{0\ldots3}<D$) relative to the start of the stagger interval 108. In general, there will be S updates per stagger interval, where S is the number of segments in the original PWM waveform. This irregular, short-term pattern 110 repeats itself exactly, but offset by one row (modulo the number of rows) during each subsequent stagger interval 108. The pattern as shown in FIG. 6 is illustrated in tabular form in Table 2. Due to its repetitive structure, this desired row access sequence for an entire frame can be recreated by simply adding, modulo the number of rows, a 'row base' that is incremented once per stagger interval 108, and a 'row offset' that steps cyclically through a short list of values once per update event. This base+offset decomposition of the row pattern is also shown in Table 2. On the time scale of the entire frame, bandwidth has been optimized as the average data rate is completely uniform on time scales larger than the row-stagger interval.

In addition, since in this example (and in most cases of interest) no events need occur simultaneously, no clearing is necessary to pad the duration of a PWM segment as is shown in U.S. Pat. No. 5,731,802. In rare cases, the staggering method of the present invention may yield an event timing in which two or more events must occur simultaneously. However, according to another embodiment of the present invention, a re-quantization method as described below addresses this situation.

TABLE 2

| Time | Updated row | Sub-interval counter | Row 'base' | Row 'offset' | Bit plane |
|---|---|---|---|---|---|
| $0 + t_0$ | 0 | 0 | 0 | 0 | 3 |
| $0 + t_1$ | 1 | 1 | 0 | 1 | 0 |
| $0 + t_2$ | 6 | 2 | 0 | 6 | 2 |
| $0 + t_3$ | 3 | 3 | 0 | 3 | 1 |
| $D + t_0$ | 1 | 0 | 1 | 0 | 3 |

TABLE 2-continued

| Time | Updated row | Sub-interval counter | Row 'base' | Row 'offset' | Bit plane |
|---|---|---|---|---|---|
| $D + t_1$ | 2 | 1 | 1 | 1 | 0 |
| $D + t_2$ | 7 | 2 | 1 | 6 | 2 |
| $D + t_3$ | 4 | 3 | 1 | 3 | 1 |
| $2D + t_0$ | 2 | 0 | 2 | 0 | 3 |
| $2D + t_1$ | 3 | 1 | 2 | 1 | 0 |
| $2D + t_2$ | 8 | 2 | 2 | 6 | 2 |
| $2D + t_3$ | 5 | 3 | 2 | 3 | 1 |
| $3D + t_0$ | 3 | 0 | 3 | 0 | 3 |
| $3D + t_1$ | 4 | 1 | 3 | 1 | 0 |
| $3D + t_2$ | 9 | 2 | 3 | 6 | 2 |
| ... | ... | | ... | ... | |

Figure 7:
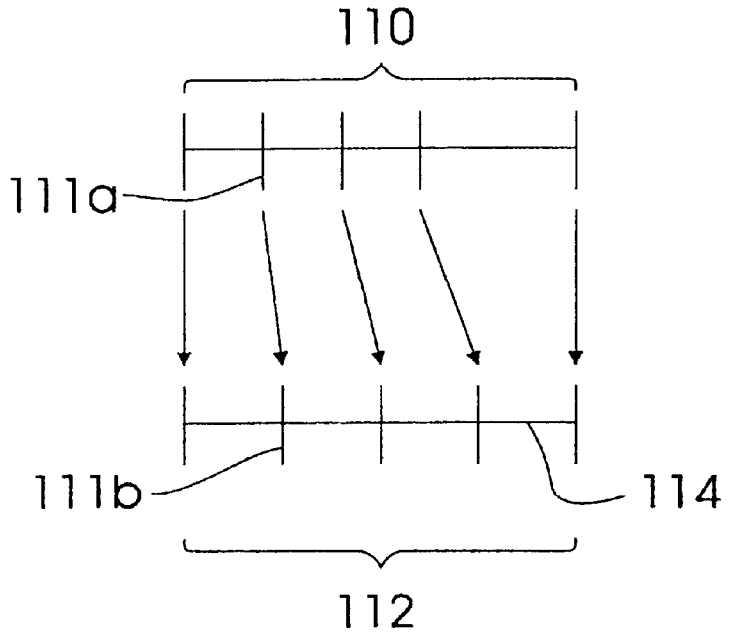
FIG. 7 illustrates a re-quantization operation according to an embodiment of the present invention.

To further simplify system design, according to one embodiment, the short-term irregularity in data rate is eliminated by 're-quantizing' the irregular intervals between update events 111*a* occurring during a stagger interval 108. FIG. 7 illustrates the re-quantization operation according to this embodiment. The re-quantized event scheduling 112 is determined by taking the original, irregular event pattern 110 and altering the timing between the original events 111*a* such that the re-quantized events 111*b* are now distributed at equal subintervals 114 of the stagger interval 108. The re-quantization operation amounts to simply replacing t0 . . . t3 with t0'. . . t3' where t0'. . . t3' are equally spaced in time within a stagger interval 108.

Such re-quantization has several effects. First, it eliminates the short-term nonuniformity in bandwidth. The throughput required of the data bus is now completely uniform over time, and thus the system now has 100% bandwidth efficiency. For this example, a system based upon the teachings of the present invention will achieve the same frame rate as the system shown in FIG. 5 while requiring only 80% of the data bus speed. Alternately, using a bus of the same speed as the system shown in FIG. 5, the present invention will achieve a 25% faster frame rate, thereby reducing undesired flicker.

Figure 8:
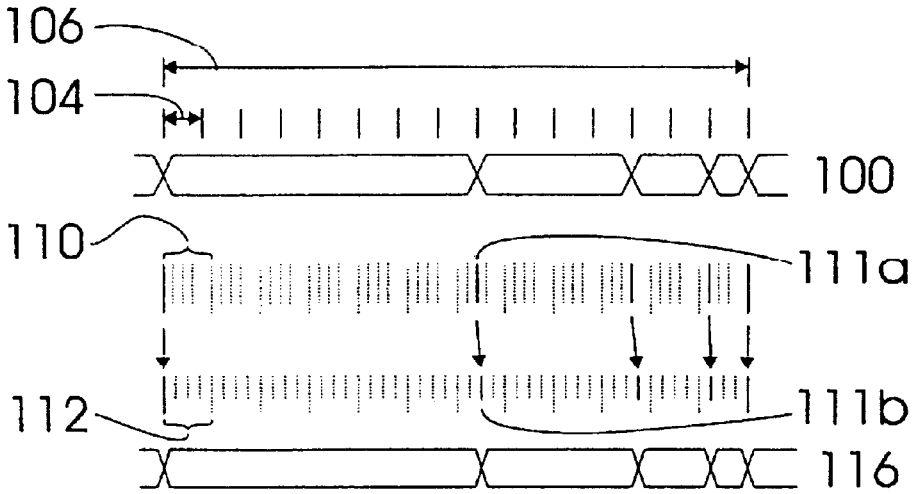
FIG. 8 illustrates an example of the effect of re-quantization operation on PWM weighting according to an embodiment of the present invention.

A second effect of such re-quantization is that it slightly alters the weights of the PWM segments as shown in FIG. 8. The durations of the segments of the re-quantized waveform 116 are no longer exactly equal to the desired binary-weighted values of the original waveform 100. If the display data is written directly to the SLM with the timing as shown, small deviations from the desired linear relationship between the numeric pixel value and perceived pixel brightness would result.

Figure 9:
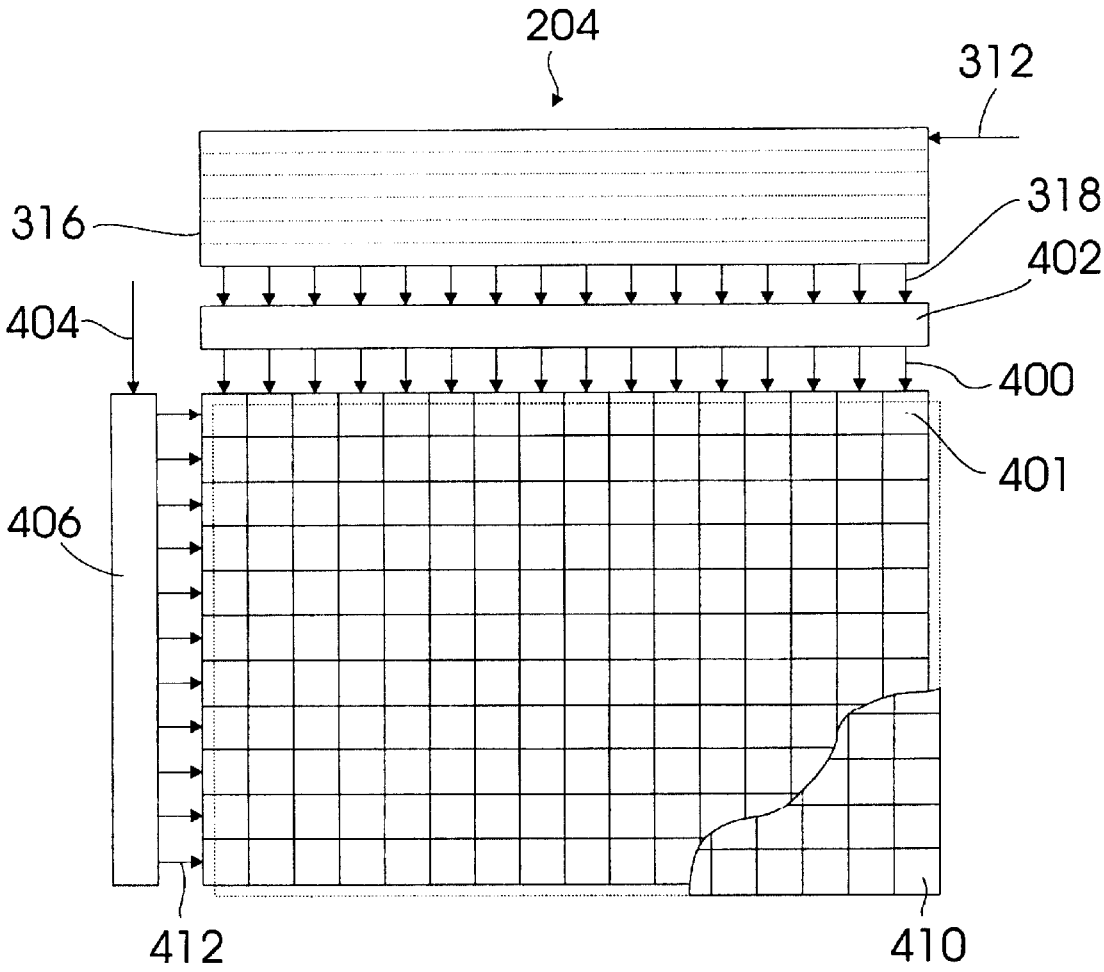
FIG. 9 illustrates an SLM architecture including a buffer for obtaining ideal PWM weights according to an embodiment of the present invention.

FIG. 9 illustrates one solution to the problem of such non-ideal PWM segment weightings according to an embodiment of the present invention. As shown in FIG. 9, according to an embodiment of the present invention, a FIFO buffer 316 having a capacity equal to the number of bits in a row times the number of events in a stagger interval 108 is incorporated into the SLM 204. Display data enters FIFO buffer 316 from data bus 312 at a uniform rate. Since FIFO buffer 316 is on-board SLM 204, its interface 318 to the bitline drivers 402 may be made wider and faster than input data bus 312 with negligible cost. Using this fast bus, data may be loaded from FIFO buffer 316 into the SLM array 401 with the desired, locally-irregular timing pattern 110 that would yield perfect PWM weights.

An alternative is to simply ignore the timing error. In many cases of practical interest (for example, 8-bit binary-weighted grayscale on standard PC monitor resolutions) the worst-case error is substantially smaller than an LSB as shown in Table 3. In most applications, a fraction of an LSB of error is tolerable. If these small errors are acceptable, the SLM FIFO buffer 316 is rendered unnecessary and may be eliminated to reduce system complexity and cost.

In Table 3, INL refers to a measure of the integral non-linearity in a D/A system and DNL refers to a measure of the differential non-linearity in a D/A system. Resolution/bit depth combinations in which the number of rows is less than the total PWM weight are marked with an asterisk.

TABLE 3

| Resolution (rows) | Bit depth | INL | DNL |
|---|---|---|---|
| 240* | 8 | 0.23 | 0.20 |
| 480 | 8 | 0.11 | 0.14 |
| 600 | 8 | 0.17 | 0.10 |
| 720 | 8 | 0.14 | 0.11 |
| 768 | 8 | 0.15 | 0.17 |
| 1024 | 8 | 0.13 | 0.13 |
| 1080 | 8 | 0.05 | 0.06 |
| 1200 | 8 | 0.08 | 0.06 |
| 480* | 10 | 0.78 | 0.57 |
| 600* | 10 | 0.50 | 0.36 |
| 720* | 10 | 0.25 | 0.28 |
| 768* | 10 | 0.75 | 0.60 |
| 1024 | 10 | 0.58 | 0.80 |
| 1080 | 10 | 0.31 | 0.24 |
| 1200 | 10 | 0.25 | 0.15 |

For rare combinations of the PWM waveform weighting and the display size, the staggering operation may result in two or more events being scheduled to occur simultaneously. For practical cases it is trivial to examine all possible ways in which the 'tie' between simultaneous events can be broken and select the one with the smallest PWM error.

Figure 10:
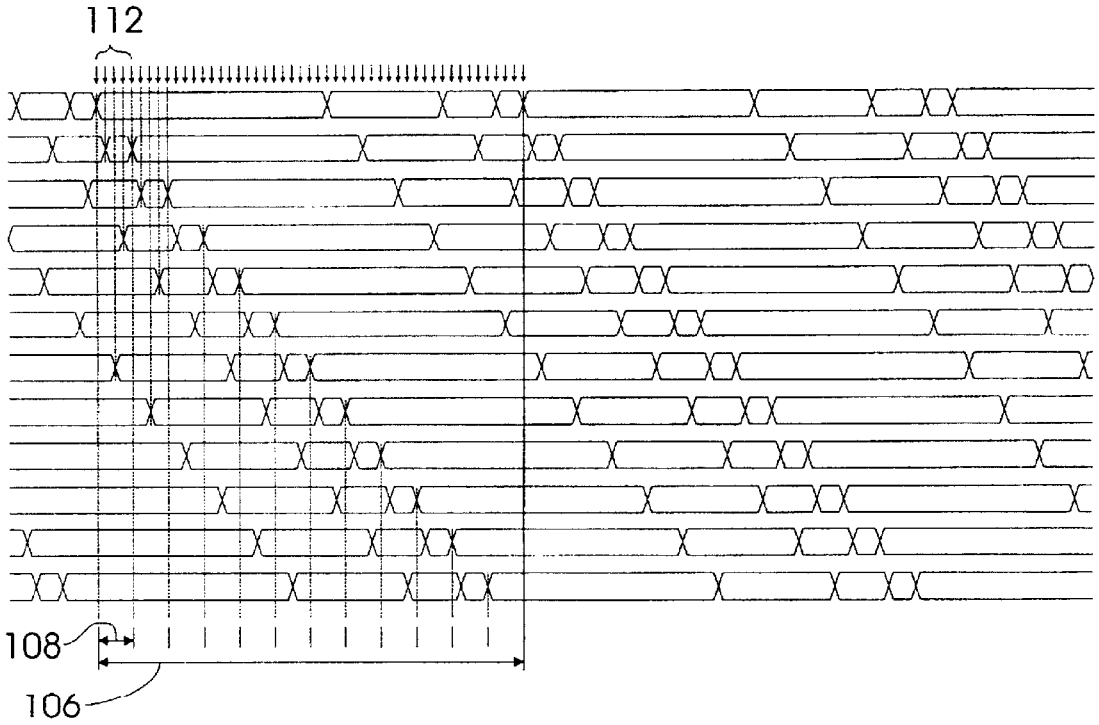
FIG. 10 illustrates an example of a global PWM pattern resulting from applying the re-quantization operation according to an embodiment of the present invention.

FIG. 10 shows the global PWM pattern resulting from applying the re-quantization operation of the present invention to the original PWM pattern of FIG. 6. As can be seen, the distribution of the update events in time is completely uniform.

Figure 15:
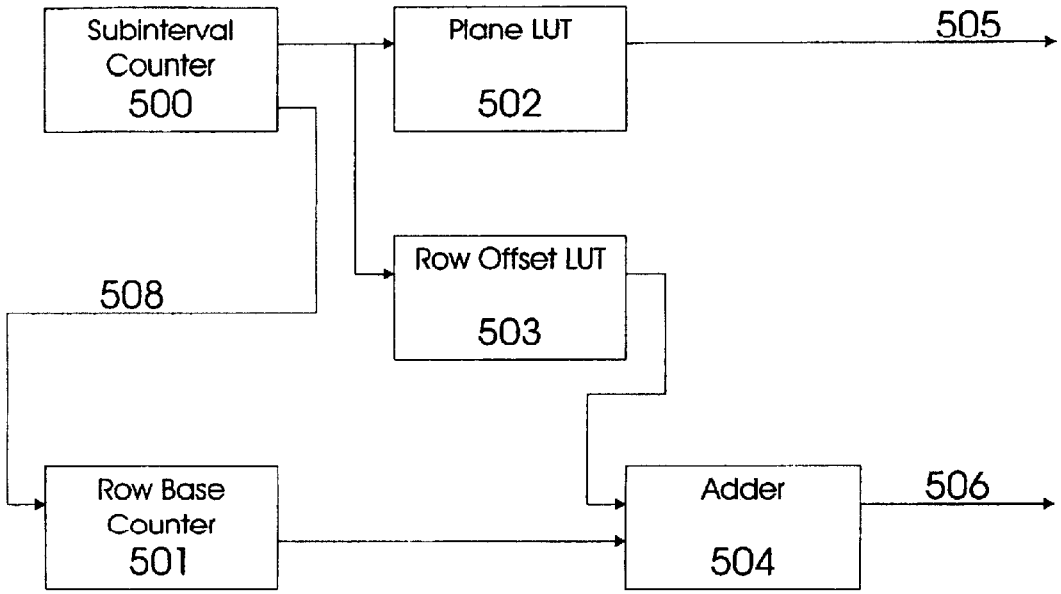
FIG. 15 illustrates a preferred implementation of the address-generation circuitry of a display controller according an embodiment of the present invention.

FIG. 15 shows a preferred implementation of the display controller's address-generation circuitry according to one embodiment. During each subinterval 114, the display controller computes (using the address generation circuit of FIG. 15) the selected row 506 and plane 505 associated with the next event in the PWM pattern of FIG. 10, fetches from the frame buffer 310 the pixel data associated with the selected row 506 and plane 505 of the image, and stores this pixel data into the associated row of pixels on the SLM 204.

The subinterval counter 500 starts at zero at the beginning of each stagger interval 108 and increments once per subinterval 114. Each time the subinterval counter 500 wraps around to zero, the subinterval counter's terminal-count signal 508 signals the row base counter 501 to increment. The offset lookup table 503 and plane lookup table 502 generate an offset 507 and plane 505 based on the value of the subinterval counter. The subinterval counter corresponds to the 'subinterval counter' column of Table 2, and the contents of the lookup tables (LUTs) 503 and 502 are respectively equivalent to the 'Row offset' and 'Bit plane' columns of Table 2. Adder 504 adds the value of the row base counter 501 to the output of the row offset LUT 503 (modulo the number of rows) to generate the selected row 506. The selected plane 505 is taken directly from the output of the plane LUT 502.

An additional advantage of the present invention is that it is possible to generate a PWM display with a greater number of grayscale levels than the number of rows, as is shown in some of the entries in Table 3. Typically, it is possible to achieve a grayscale bit depth of approximately double the number of rows multiplied by the number of PWM waveform segments with reasonable error. Additionally, in the embodiment using a FIFO buffer 316, the number of grayscale levels is completely independent of the number of rows.

There is no reason why the logical numbering of the rows shown above must map directly to the spatial positions of the rows in the array as is shown in column 2 of Table 4. According to one embodiment, by assigning logical row numbers to physical rows in an interleaved fashion as shown in column 3 or 4 of Table 4, the PWM waveforms of physically-adjacent rows are de-correlated in time, and undesirable perceptual artifacts such as flicker are reduced.

The PWM algorithm itself is independent of the chosen logical-to-physical row mapping, and any desired mapping may be selected. Examples of mappings include, but are not limited to:

1. Interleaved: logical rows {0,1,2 . . . n−1} map to physical rows {0,2,4,6 . . . n−2,1,3,5,7 . . . n−1}
2. Interleaved-by-k: logical rows {0,1,2 . . . n−1} map to physical rows {0,k,2k,3k, . . . , 1,k+1,2k+1,3k+1, . . . 2,k+2,2k+2,3k+2, etc.}
3. Bit-reversed: logical row with binary representation (10-bit example) $b_9b_8b_7b_6b_5b_4b_3b_2b_1b_0$ maps to physical row $b_0b_1b_2b_3b_4b_5b_6b_7b_8b_9$ One skilled in the art will observe that, in an actual implementation, it is not necessary to generate a logical row address and translate it, to a physical row address in two separate steps. Instead, the row base counter 501, adder 504 and offset LUT 503 may be modified to directly generate the desired physical row number without the intermediate step of computing the logical row number.

TABLE 4

| Logical row # | Physical row # (standard) | Physical row # (interleaved) | Physical row # (interleaved-by-3) |
|---|---|---|---|
| 0 | 0 | 0 | 0 |
| 1 | 1 | 2 | 3 |
| 2 | 2 | 4 | 6 |
| 3 | 3 | 6 | 9 |
| 4 | 4 | 8 | 1 |
| 5 | 5 | 10 | 4 |
| 6 | 6 | 1 | 7 |
| 7 | 7 | 3 | 10 |
| 8 | 8 | 5 | 2 |
| 9 | 9 | 7 | 5 |
| 10 | 10 | 9 | 8 |
| 11 | 11 | 11 | 11 |

The above methods achieve the stated objectives and advantages for grayscale displays. To most effectively use these methods in a field-sequential-color (FSC) system, some additional features may be necessary.

In some FSC systems (especially those based on rotating color wheels), the transition between illumination colors is not instantaneous and can not be guaranteed to occur at an exact time. If pixels of the array are left on during this period of uncertain illumination, inaccurate color reproduction may result. It is therefore necessary that all pixels be switched off during a finite-duration 'blanking' interval to avoid sending light of uncontrolled color and intensity to the viewer. It is simple to clear the array quickly. As discussed in the prior art, specialized circuits on the SLM can load the pixels with fixed values at a rate unconstrained by the bandwidth of the data bus. However, re-filling the array with data at the end of the blanking interval is constrained by the bus bandwidth. This constraint affects the optical efficiency of methods such as the method described in U.S. Pat. No. 5,448,314 where, after the blanking interval ends, significant dead time elapses before all pixels have been refilled.

Figure 11:
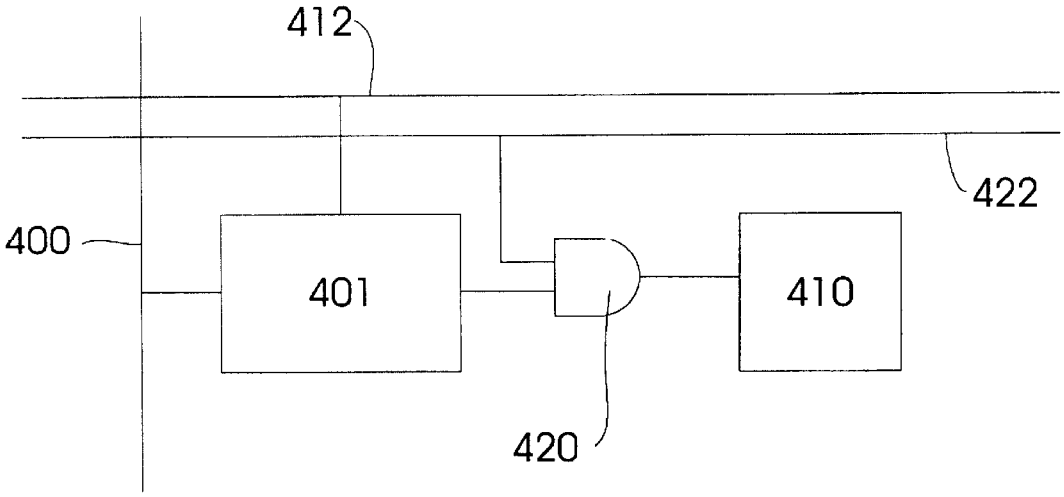
FIG. 11 illustrates an SLM cell with a blanking circuit according to an embodiment of the present invention.

FIG. 11 shows an SLM memory cell 401 and associated pixel 410 with an added gating circuit 420 according to an embodiment of the present invention which is particularly useful for field-sequential color SLMs. Gating circuit 420 is used to force light-modulating element 410 to the off state during the blanking interval. In a preferred embodiment, gating circuit 420 includes an AND gate. In this embodiment, when the global blanking-control signal 422 is 0, the AND gate forces pixel 410 to the off state. In this manner, a plurality of gating circuits can be used to force all pixels to the off state during the blanking interval. It will be appreciated that an OR, NAND, or NOR gate may be substituted for the AND gate with the appropriate choice of the polarity of the blanking-control signal 422 and pixel bias 424. By gating the output of the pixel memory cell, as opposed to actually clearing the memory cell itself as in the prior art, it is possible to use the time of the blanking interval to pre-load the SLM with data, rather than wait until the end of the blanking interval to begin filling the array. This reduces pixel 'dead time' and improves optical efficiency.

Figure 12:
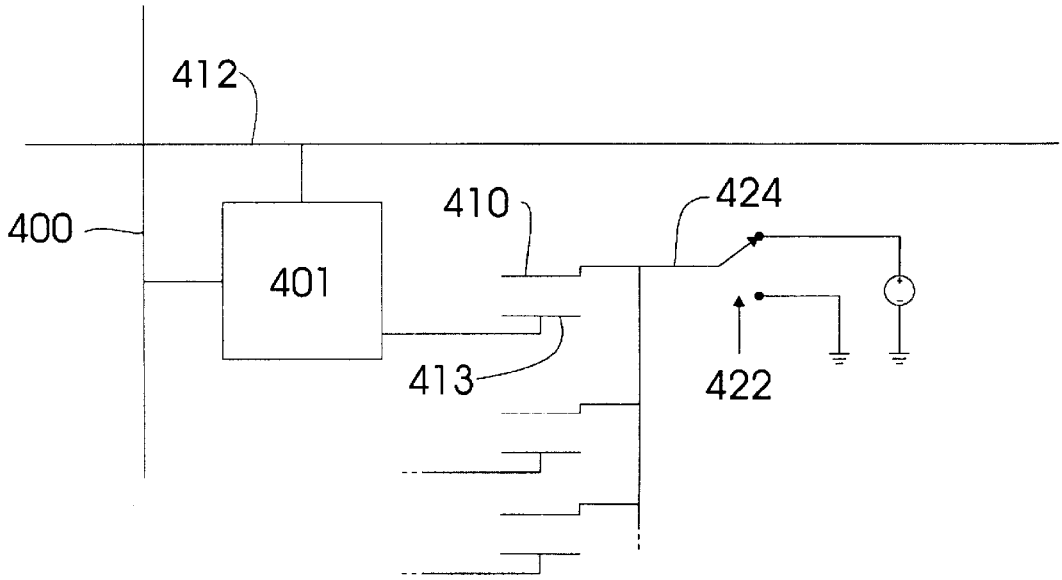
FIG. 12 illustrates an alternate global blanking circuit according to an embodiment of the present invention.

FIG. 12 illustrates a blanking circuit according to an alternate embodiment of the invention. In this embodiment, pixel 410 is actuated electrostatically by the voltage difference between the voltage applied to electrode 413 driven by the memory cell 401 and the bias voltage 424 applied to the pixel 410. In normal operation, the bias voltage 424 applied to pixel 410 is at its normal level and the pixel's state reflects the contents of the SLM memory cell 401. When the blanking-control signal 422 is applied, the bias voltage 424 applied to pixel 410 is disabled such that pixel 410 switches to the off state, regardless of the state of memory cell 401 and electrode 413.

In yet another alternate embodiment, a circuit connected to the illuminating light source is used to disable the light source in response to a blanking signal. Additionally, a circuit coupled to an optical element, such as a high-speed shutter or any other element having the capability to interrupt the illumination impinging on the pixel array for the appropriate duration, may be used.

Figure 13:
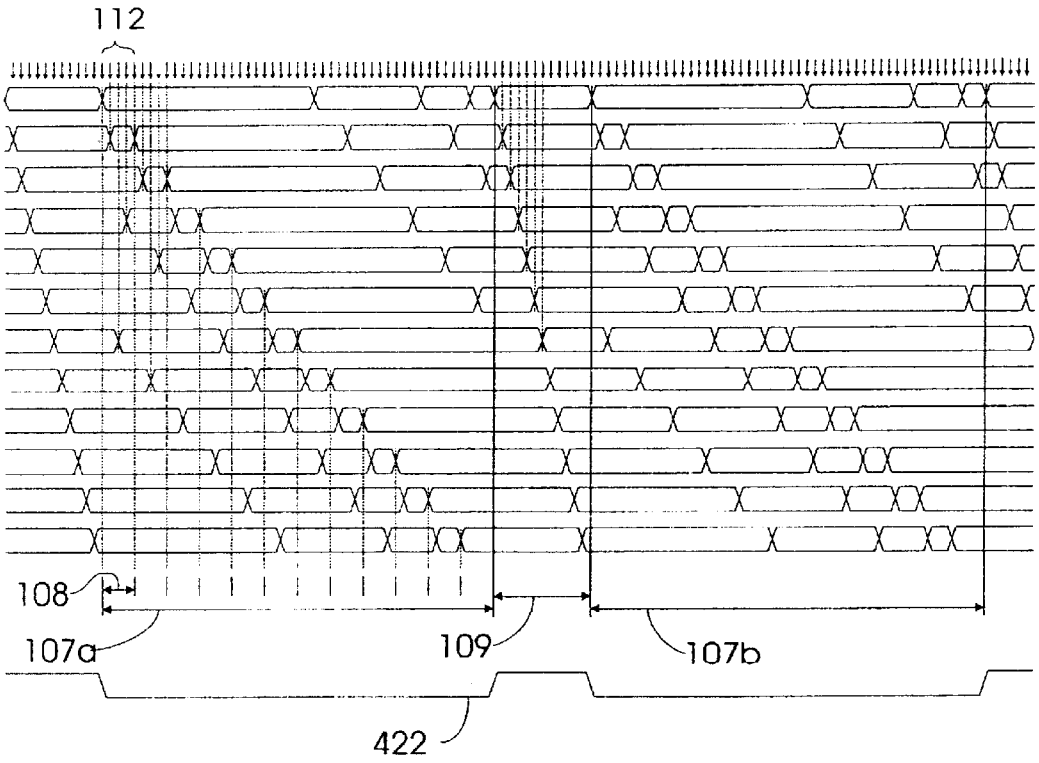
FIG. 13 illustrates a field-sequential-color PWM method according to an embodiment of the present invention.

FIG. 13 shows a modified PWM method for a field-sequential color system using a blanking method according to an embodiment of the present invention. For the duration 107*a* of one color field, the SLM is illuminated with colored light of the desired color. One complete cycle of the gray-scale PWM pattern described above is performed for the single color field 107*a*. At the end of the field, the array is blanked by asserting the blanking-control signal 422. At this point in time all pixels of the display turn off. While the display is blanked, the illumination system changes the color of the illumination to that required for the subsequent color field 107*b*. During blanking, the normal PWM access pattern is suspended, and the pixels of the array are preloaded with data such that, when the blanking interval 109 ends, the normal PWM modulation pattern of the next field 107*b* is resumed in 'midstream.' In this manner, the blanking circuits of the present invention allow one color field's PWM pattern to be efficiently interrupted and resumed in order to display the next color field.

Figure 14:
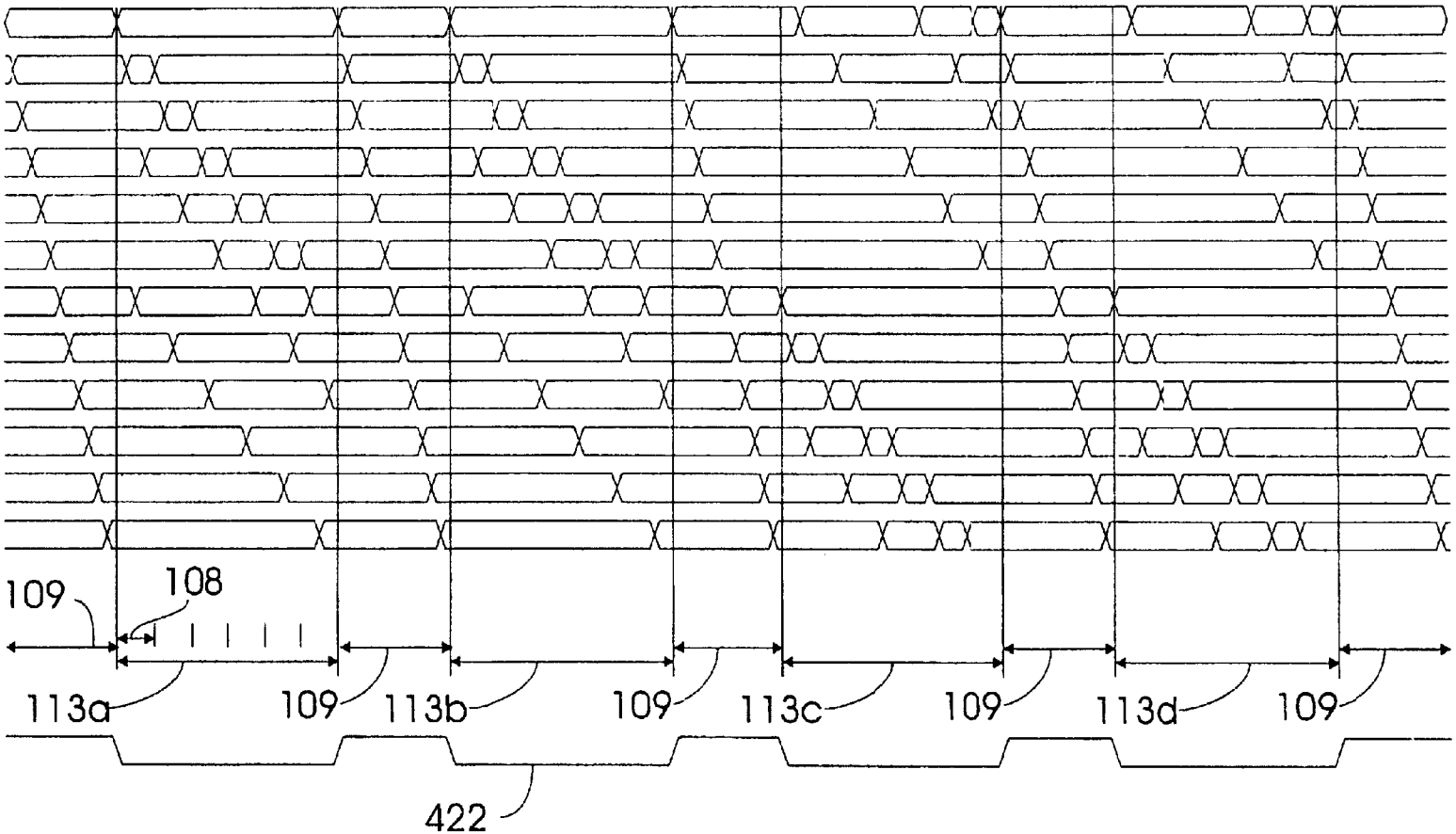
FIG. 14 illustrates an alternate field-sequential-color PWM method according to an embodiment of the present invention.

It is not required to stop and start a color field's PWM pattern only after one complete cycle through the modulation pattern. By interrupting a color field's PWM pattern two or more times per frame, each color field can be broken up into subfields. These subfields can be displayed at a substantially higher rate, with the only increase in bandwidth being the overhead of more blanking 'context-switches' per unit time as shown in FIG. 14. As in the FSC system of FIG. 13, the duration of each blanking interval 109 is used to preload the array with the data that will allow the modulation pattern to be resumed in 'midstream' at the end of the blanking period. The example in FIG. 14 shows the access pattern for a system with two colors (although a typical system would have three colors, for clarity the example has been simplified to two colors) and two subfields per color field. During each subfield 113*a–d* of a complete frame, the following patterns are displayed:

- subfield 1 (113*a*): first half of first color's modulation pattern;
- subfield 2 (113*b*): first half of second color's modulation pattern;
- subfield 3 (113*c*): second half of first color's modulation pattern; and
- subfield 4 (113*d*): second half of second color's modulation pattern.

Breaking each color field into subfields in this manner allows the rate at which the illumination switches colors to be doubled, tripled, or more, with only a modest penalty in optical efficiency and required bandwidth as shown in Table 5. A higher color field rate reduces the amount of color 'breakup' perceived by the user. The rate at which the illumination system switches colors has been greatly increased, while the actual period of each pixel's modulation pattern remains substantially the same, the minimum switching time of the light-modulating elements remains substantially the same, the required bandwidth increases modestly, and the optical efficiency decreases modestly. A distinct advantage of this method is that the color-switching rate may be increased while incurring a bandwidth penalty substantially less-than-linearly proportional to the increase in color switching rate.

TABLE 5

| Modulation method | Relative bandwidth | Optical efficiency |
|---|---|---|
| Standard 8-bit field-seq. color at 60 Hz | 1.00 | 89% |
| 8-bit 2-subfield sequential color at 120 Hz | 1.11 | 80% |
| 8-bit 3-subfield sequential color at 180 Hz | 1.25 | 73% |
| Standard 10-bit field-seq. color at 60 Hz | 1.22 | 91% |
| 10-bit 2-subfield sequential color at 120 Hz | 1.33 | 83% |
| 10-bit 3-subfield sequential color at 180 Hz | 1.44 | 77% |

In a further refinement of this subfield-sequential color method, the subfields derived by breaking up the original complete field cycle need not be displayed in their 'natural' sequence. By reordering the subfields, the energy of the pixels' MSBs is more evenly distributed over the frame period, thereby reducing flicker.

While the invention has been described by way of example and in terms of the specific embodiments, it is to be understood that the invention is not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A spatial light modulator (SLM) comprising:

an array of pixel elements;

an array of memory cells coupled to the array of pixel elements and having a plurality of rows, wherein each memory cell controls the state of one of the pixel elements; and a plurality of gating circuits, each gating circuit coupled to one of the pixel elements;

wherein when a blanking control signal is applied to the gating circuits, all associated pixel elements are simultaneously forced to an off state regardless of the content of the associated memory cells.

2. The SLM of claim 1, further including a signal line coupled to each gating circuit for simultaneously applying the blanking control signal to each gating circuit.

3. The SLM of claim 2, wherein each gating circuit includes a logical AND gate having a first input terminal coupled to the signal line and a second input terminal coupled to the output of the associated memory cell, and an output terminal coupled to the associated pixel element, wherein when the blanking control signal applied to the AND gates is low, all associated pixel elements are simultaneously forced to the off state.

4. The SLM of claim 2, wherein each gating circuit includes a logical gate selected from the group consisting of an AND gate, an OR gate, a NOR gate and a NAND gate.

5. A spatial light modulator (SLM) comprising:

an array of electrostatic pixel elements;

an array of memory cells coupled to the array of pixel elements, wherein each memory cell controls the state of one of the pixel elements by applying a control voltage to the corresponding pixel element; and a switching circuit coupled to all of the pixel elements for providing a bias voltage to all the pixel elements, wherein when the bias voltage is at a first level the state of each pixel is controlled by the control voltage from the respective memory cell, and wherein when the bias voltage is at a second level all pixel elements are, in an off state, wherein when a blanking signal is applied to the switching circuit, the switching circuit switches the bias voltage to the second level such that all pixel elements are simultaneously forced to an off state regardless of the applied control voltages.

6. A method of driving a spatial light modulator (SLM) in a field-sequential-color (FSC) display system, wherein the SLM includes an array of memory cells coupled to an array of pixel elements, said array of memory cells comprising a plurality of rows, wherein each memory cell controls the state of one of the pixel elements, wherein the FSC system includes a color generating mechanism capable of illuminating the pixel elements with multiple color fields, the method comprising the steps of:

illuminating the pixel elements with the multiple color fields in a cyclical manner, wherein each color field illuminates the SLM one or more times during a frame;

during each field, selecting the rows of the SLM in an update sequence having a plurality of update events, each update event in said update sequence corresponding to a predetermined row of an image and one of a plurality of predetermined bitplanes of said image, each bitplane having a predetermined pixel waveform segment duration;

providing a plurality of image data signals to the SLM at each update event, such that the selected row of the SLM is updated with image data corresponding to the selected row and bitplane of the image;

between each subsequent color field, blanking all pixel elements for an interval having a predetermined duration; and during each blanking interval, pre-loading the memory cells of the SLM such that when the blanking interval ends, the next color field's update sequence may be resumed in a continuous manner so as to eliminate pixel dead time after the end of the blanking interval.

7. The method of claim 6, wherein the update events for each row are staggered relative to the update events of a previous row in a row order, wherein during each stagger interval a number of update events occur, said number of update events being equal to the number of update events occurring for each row during a frame.

8. The method of claims 7, wherein the stagger interval has a duration equal to the frame duration divided by the number of said plurality of rows.

9. The method of claim 6, wherein the FSC system includes a light source and a color wheel, wherein the step of illuminating the pixels with the multiple color fields in a cyclical manner includes the steps of illuminating the color wheel with the light source and rotating the color wheel such that the color of the illumination incident on the SLM is synchronized with the color field data displayed on the SLM.

10. The method of claim 6, wherein the color fields include a red (R), a green (G) and a blue (B) color field.

11. The method of claim 6, wherein each color field illuminates the pixel array two or more times during a cycle.

12. The method of claim 6, wherein the durations of the color fields are different during a cycle.

13. A method of reducing an amount of flicker perceived by a viewer in a field-sequential color (FSC) system having a spatial light modulator (SLM), wherein the SLM includes an array of memory cells coupled to an array of pixel elements, said memory cell array comprising a plurality of rows, wherein each memory cell controls the state of one of the pixel elements, wherein the FSC system includes a color generating mechanism capable of illuminating the pixel elements with multiple color fields, the method comprising the steps of:

illuminating the pixel elements with the multiple color fields in a cyclical manner, wherein each color field illuminates the SLM two or more times during a frame;

during each field, selecting the rows of the SLM in an update sequence having a plurality of update events, each update event in said update sequence corresponding to a predetermined row of an image and one of a plurality of predetermined bitplanes of said image, each bitplane having a predetermined pixel waveform segment duration;

providing a plurality of image data signals to the SLM at each update event, such that the selected row of the SLM is updated with image data corresponding to the selected row and bitplane of the image;

blanking all pixel elements between each subsequent color field for an interval having a predetermined duration; and during each blanking interval, preloading the memory cells with data such that when the blanking interval ends, the next color field's update sequence may be resumed in a continuous manner so as to reduce the amount of flicker perceived by the viewer.

14. The method of claim 13, wherein the update events for each row are staggered relative to the update events of a previous row in a row order, wherein during each stagger interval a number of update events occurs, said number of update events occurring during each stagger interval being equal to the number of update events occurring for each row during a frame.

15. The method of claim 14, wherein the stagger interval has a duration equal to the frame duration divided by the number of said plurality of rows.

16. The method of claim 13, wherein the FSC system includes a light source and a color wheel, wherein the step of illuminating the pixels with the multiple color fields in a cyclical manner includes the steps of illuminating the color wheel with the light source and rotating the color wheel such that each color field illuminates the pixel array two or more times during a cycle.

17. The method of claim 13, wherein the color fields include a red (R), a green (G) and a blue (B) color field.

18. A method of reducing an amount of color breakup perceived by a viewer in a field-sequential color (FSC) system having a spatial light modulator (SLM) driven by bitplane data signals, wherein the SLM includes an array of memory cells coupled to an array of pixel elements, wherein each memory cell controls the state of one of the pixel elements, wherein the FSC system includes a color generating mechanism capable of illuminating the pixel elements with multiple color fields, the method comprising the steps of:

illuminating the pixel elements with the multiple color fields in a cyclical manner, wherein each color field illuminates the SLM during each cycle;

providing bitplane data signals to the memory cells such that during each color field each of a plurality of rows of memory cells is updated by one or more of a plurality of update bitplanes, each update bitplane having a predetermined weight;

simultaneously blanking all pixel elements one or more times during each separate color field for an interval having a predetermined duration, so as to split each color field into two or more subfields;

simultaneously blanking all pixel elements between each separate color field for said interval having said predetermined duration; and during each blanking interval, preloading the memory cells with data such that when the blanking interval ends, the update sequence may be resumed in a continuous manner for the next color field or subfield.

19. The method of claim 18, wherein the update events foor each row are staggered by a stagger interval relative to the update events of a previous row in a row order, the stagger interval has a duration equal to the frame duration divided by the number of said plurality of rows.

20. The method of claim 18, wherein the update events for each row are staggered relative to the update events of a previous row in a row order, wherein during each stagger interval a number of update events occurs, said number of update events occurring during each stagger interval being equal to the number of update events occurring for each row during a frame.

21. The method of claim 18, wherein the FSC system includes a light source and a color wheel, wherein the step of illuminating the pixels with the multiple color fields in a cyclical manner includes the steps of illuminating the color wheel with the light source and rotating the color wheel.

22. The method of claim 18, wherein the color fields include a red (R), a green (G) and a blue (B) color field.

23. A method of driving a spatial light modulator (SLM), wherein the SLM has a plurality of rows, each row having a plurality of pixels, wherein each pixel includes a storage bit and a light-modulating element, and wherein each of the plurality of rows is updated with pixel data at each of a plurality of update events during each of a plurality of frames to be displayed by the SLM, wherein each update event has a predetermined weight, the method comprising the steps of, for each frame:

writing pixel data associated with a first bitplane and a first one of the plurality of rows to the first row at a first update time;

writing pixel data associated with said first bitplane and a second one of the plurality of rows to the second row at a second update time different from the first update time by a stagger interval with duration equal to the frame duration divided by the number of said plurality of rows.

24. The method of claim 23, wherein the first and second rows are physically adjacent to each other.

25. The method of claim 23, wherein the method further comprises the step of, for each of the remaining subsequent rows, writing pixel data associated with said first bitplane and the row to the row at subsequent update times each separated by said stagger interval.

26. The method of claim 25, wherein during each stagger interval, a number of update events occur in the SLM, said number of update events being equal to the number of the plurality of update events occurring to a row during a frame.

27. A method of driving a spatial light modulator (SLM), wherein the SLM has a plurality of rows, each row having a plurality of pixels, wherein each pixel includes a storage bit and a light-modulating element, and wherein each of the plurality of rows is updated with pixel data at a plurality of update events, said events corresponding to at least two bitplanes, during each of a plurality of frames to be displayed by the SLM, wherein each update event has a predetermined weight, the method comprising the steps of, for each frame:

for each row, writing to the row pixel data associated with the row and a first bitplane at a first update event, said first update event occurring at a first update time wherein the first update time for the row is staggered from the first update time of the previous row by a stagger interval with duration equal to the frame duration divided by the number of said plurality of rows; and for each row, writing to the row pixel data associated with the row and a second bitplane at a second update event, said second update event occurring at a second update time, wherein the second update time for the row is different from the first update time for the row by a duration based on the weight corresponding to the first update event, and wherein the second update time for the row is different from the second update time of the previous row by said stagger interval.

28. The method of claim 27, wherein each row is physically adjacent to its previous row.

29. The method of claim 27, wherein the first update events of each of the plurality of rows are staggered in a logical row order.

30. The method of claim 29, wherein the logical order corresponds to a physically sequential order.

31. The method of claim 29, wherein the logical order corresponds to a physically random order.

32. The method of claim 29, wherein the logical order corresponds to a physically interleaved order.

33. A method for displaying an image comprising:

providing a spatial light modulator having a plurality of pixels, displaying a plurality of frames on the spatial light modulator, each frame comprising a plurality of bitplanes;

subdividing each frame into a plurality of stagger intervals;

subdividing each stagger interval into a plurality of subintervals;

during each subinterval, updating a subset of said plurality of pixels with pixel data corresponding to the subset of pixels and a bitplane of the plurality of bitplanes;

wherein the frame is provided without dummy pixel subsets.

34. The method of claim 33, wherein the subsets of the plurality of pixels are rows or columns within a pixel array made up of said plurality of pixels.

35. A method for displaying an image comprising.

providing a spatial light modulator having a plurality of pixels;

displaying a plurality of frames on the spatial light modulator, each frame comprising a plurality of bitplanes;

subdividing each frame into a plurality of stagger intervals;

subdividing each stagger interval into a plurality of subintervals; during each subinterval, updating a subset of said plurality of pixels with pixel data corresponding to the subset of pixels and a bitplane of the plurality of bitplanes;

wherein the length of at least one of the stagger intervals is equal to the frame duration divided by the number of rows.

36. A method for displaying an image comprising:

providing a spatial light modulator having a plurality of pixels;

displaying a plurality of frames on the spatial light modulator, each frame comprising a plurality of bitplanes;

subdividing each frame into a plurality of stagger intervals;

subdividing each stagger interval into a plurality of subintervals;

during each subinterval, updating a subset of said plurality of pixels with pixel data corresponding to the subset of pixels and a bitplane of the plurality of bitplanes;

wherein for at least half of the stagger intervals in a frame, the number of subsets of the plurality of pixels in the spatial light modulator that are updated is the same.

37. The method of claim 36, wherein at least 80% of the stagger intervals in a frame have the same number of pixel subsets updated.

38. The method of claim 37, wherein in all of the stagger intervals, the number of pixel subsets that are updated is the same.

39. The method of claim 36, wherein the pixel subsets are rows or columns of pixels within a pixel array comprising said plurality of pixels.

40. A method for displaying an image comprising:

providing a spatial light modulator having a plurality of pixels;

displaying a plurality of frames on the spatial light modulator, each frame comprising a plurality of bitplanes;

subdividing each frame into a plurality of stagger intervals;

subdividing each stagger interval into a plurality of subintervals;

during each subinterval, updating a subset of said plurality of pixels with pixel data corresponding to the subset of pixels and a bitplane of the plurality of bitplanes;

wherein the total number of pixel subsets updated in a frame divided by the number of pixel subsets is greater than (X−20%), where X is the number of bits in an X-bit binary weighted waveform.

41. The method of claim 40, wherein the total number of pixel subsets updated in a frame divided by the number of pixel subsets is greater than (X−10%).

42. The method of claim 41, wherein the total number of pixel subsets updated in a frame divided by the number of pixel subsets is greater than (X−1%).

43. The method of claim 40, wherein the pixel subsets are rows or columns of a pixel array made up of said plurality of pixels.

44. A method for displaying a color image, that is made up of a plurality of color component images, comprising:

a) providing a spatial light modulator having a plurality of pixels;

b) displaying a plurality of color component images for each frame on the spatial light modulator, each color component image comprising a plurality of bitplanes;

c) subdividing each frame into a plurality of color fields;

c) subdividing each color field into a plurality of stagger intervals;

d) subdividing each stagger interval into a plurality of subintervals;

e) during each subinterval, updating a subset of said plurality of pixels with pixel data corresponding to the subset of pixels and a bitplane of the color component image;

f) wherein the duration of each color field is less than the number of pixel subsets multiplied by the length of the stagger interval.

45. The method of claim 44, wherein the-duration of each color field is one half or less of the number of pixel subsets multiplied by the length of the stagger interval.

46. The method of claim 45, wherein the duration of each color field is from ¼to ½the length of the stagger interval multiplied by the number of pixel subsets.

47. The method of claim 44, wherein the pixel subsets are rows or columns in a pixel array made up of said plurality of pixels.

48. The method of any of claims 35, or 44, wherein the pixel subsets are rows or columns of pixels within a pixel array made up of said plurality of pixels.

49. The method of any of claims 33, 35, 36, 42, or 44, wherein the pixels are deflectable micromirrors or deflectable diffractive elements.

50. The method of any of claims 33, 35, 36, 40, or 44, wherein the pixels comprise liquid crystal and are part of a transmissive or reflective liquid crystal display.

51. A spatial light modulator (SLM) comprising:

an array of pixel elements;

an array of memory cells coupled to the array of pixel elements, wherein each memory cell controls the state of one of the pixel elements; and a blanking means, coupled to the pixel elements, for simultaneously forcing all pixel elements to an off state in response to a blanking signal regardless of the content of the memory cells, wherein the blanking means includes:

a plurality of gating circuits, each gating circuit being coupled to one of the pixel elements;

a signal line coupled to each gating circuit for simultaneously applying the blanking signal to each gating circuit.

52. A spatial light modulator (SLM) comprising:

an array of pixel elements;

an array of memory cells coupled to the array of pixel elements, wherein each memory cell controls the state of one of the pixel elements; and a blanking means, coupled to the pixel elements, for simultaneously forcing all pixel elements to an off state in response to a blanking signal regardless of the content of the memory cells.

wherein the blanking means includes a switching circuit coupled to each of the pixel elements for providing a bias voltage to the pixel elements, wherein when the bias voltage is at a first level the state of each pixel is controlled by the control voltage from the respective memory cell, and wherein when the bias voltage is at a second level the pixel elements are in an off state, wherein when the blanking signal is applied to the switching circuit, the switching circuit switches to the bias voltage such that the pixel elements are simultaneously forced to the off state.

* * * * *